US006318440B1

(12) United States Patent
Cordrey et al.

(10) Patent No.: US 6,318,440 B1
(45) Date of Patent: Nov. 20, 2001

(54) ADJUSTABLE WINDOW INSULATED COVERING

(76) Inventors: Delbert E. Cordrey; Rhodora M. Cordrey, both of 5665 E. Laurite Ave., Fresno, CA (US) 93727

( * ) Notice: Subject to any disclaimer, the term of this patent is extended or adjusted under 35 U.S.C. 154(b) by 0 days.

(21) Appl. No.: 09/544,440

(22) Filed: Apr. 7, 2000

(51) Int. Cl.[7] ..... A47H 1/00
(52) U.S. Cl. ..... 160/126; 160/124
(58) Field of Search ..... 160/126, 123, 160/124, 330, 341, 345, 349.1, 349.2, 290.1, 368.1, DIG. 7, 84.05, 354, 84.01, 84.06, 121.1

(56) References Cited

U.S. PATENT DOCUMENTS

| | | | | |
|---|---|---|---|---|
| 2,391,205 | * | 12/1945 | Cleeff | 160/349.2 |
| 2,736,373 | * | 2/1956 | Truesdale | 160/124 |
| 3,743,002 | * | 7/1973 | Ford | 160/126 |
| 3,883,924 | * | 5/1975 | Grabman | 160/126 X |
| 3,983,921 | * | 10/1976 | Ford | 160/341 |
| 4,068,428 | * | 1/1978 | Peterson | 160/354 X |
| 4,188,991 | * | 2/1980 | Boyle | 160/124 |
| 4,194,550 | * | 3/1980 | Hopper | 160/121.1 |
| 4,317,481 | * | 3/1982 | Oswald | 160/DIG. 7 X |
| 4,335,774 | * | 6/1982 | Price | 160/DIG. 7 X |
| 4,391,865 | * | 7/1983 | Constance | 160/DIG. 7 X |
| 4,406,318 | * | 9/1983 | Cukierski | 160/126 |
| 4,408,650 | * | 10/1983 | Verch | 160/121.1 |
| 4,419,982 | * | 12/1983 | Eckels | 160/368.1 X |
| 4,436,137 | * | 3/1984 | Charles | 160/242 |
| 4,546,809 | * | 10/1985 | Hadfield | 160/126 |
| 4,562,675 | * | 1/1986 | Baigas et al. | 160/354 X |
| 4,679,609 | * | 7/1987 | Bateman | 160/124 |
| 5,070,924 | * | 12/1991 | Bateman | 160/124 |
| 5,170,531 | * | 12/1992 | Ryan | 160/341 X |

* cited by examiner

*Primary Examiner*—David M. Purol

(57) ABSTRACT

An adjustable window insulated covering for substantially reducing a user's heating and cooling bills. The adjustable window insulated covering includes at least one curtain member having a first layer made of foil material, a second layer made of plastic, and an intermediate layer made of insulating material; and also includes fastening members for fastening the side ends of the at least one curtain member to a window frame. As a first embodiment, the at least one curtain member includes a first and second curtain members which are movably mounted in upper and lower track members which are mounted to the window frame. As a second embodiment, the at least one curtain member is one curtain member which is carried by a roller member which is mounted in a housing which is securely mounted to a top of the window frame. As a third embodiment, the at least one curtain member is one curtain member which is detachably fastened to the window frame over the window with hook and loop fasteners.

5 Claims, 4 Drawing Sheets

ADJUSTABLE WINDOW INSULATED COVERING

BACKGROUND OF THE INVENTION

1. Field of the Invention

The present invention relates to an adjustable window insulator curtain and more particularly pertains to a new adjustable window insulated covering for substantially reducing a user's heating and cooling bills.

2. Description of the Prior Art

The use of an adjustable window insulator curtain is known in the prior art. More specifically, adjustable window insulator curtain heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,400,848; 4,687,039; 3,205,118; 4,865,106; 4,907,636; and 5,647,154.

While these devices fulfill their respective, particular objectives and requirements, the aforementioned patents do not disclose a new adjustable window insulated covering. The inventive device includes at least one curtain member having a first layer made of foil material, a second layer made of plastic, and an intermediate layer made of insulating material; and also includes fastening members for fastening the side ends of the at least one curtain member to a window frame. As a first embodiment, the at least one curtain member includes a first and second curtain members which are movably mounted in upper and lower track members which are mounted to the window frame. As a second embodiment, the at least one curtain member is one curtain member which is carried by a roller member which is mounted in a housing which is securely mounted to a top of the window frame. As a third embodiment, the at least one curtain member is one curtain member which is detachably fastened to the window frame over the window with hook and loop fasteners.

In these respects, the adjustable window insulated covering according to the present invention substantially departs from the conventional concepts and designs of the prior art, and in so doing provides an apparatus primarily developed for the purpose of substantially reducing a user's heating and cooling bills.

SUMMARY OF THE INVENTION

In view of the foregoing disadvantages inherent in the known types of adjustable window insulator curtain now present in the prior art, the present invention provides a new adjustable window insulated covering construction wherein the same can be utilized for substantially reducing a user's heating and cooling bills.

The general purpose of the present invention, which will be described subsequently in greater detail, is to provide a new adjustable window insulated covering which has many of the advantages of the adjustable window insulator curtain mentioned heretofore and many novel features that result in a new adjustable window insulated covering which is not anticipated, rendered obvious, suggested, or even implied by any of the prior art adjustable window insulator curtain, either alone or in any combination thereof.

To attain this, the present invention generally comprises at least one curtain member having a first layer made of foil material, a second layer made of plastic, and an intermediate layer made of insulating material; and also includes fastening members for fastening the side ends of the at least one curtain member to a window frame. As a first embodiment, the at least one curtain member includes a first and second curtain members which are movably mounted in upper and lower track members which are mounted to the window frame. As a second embodiment, the at least one curtain member is one curtain member which is carried by a roller member which is mounted in a housing which is securely mounted to a top of the window frame. As a third embodiment, the at least one curtain member is one curtain member which is detachably fastened to the window frame over the window with hook and loop fasteners.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable window insulated covering which has many of the advantages of the adjustable window insulator curtain mentioned heretofore and many novel features that result in a new adjustable window insulated covering which is not anticipated, rendered obvious, suggested, or even implied by any of the prior art adjustable window insulator curtain, either alone or in any combination thereof.

It is another object of the present invention to provide a new adjustable window insulated covering which may be easily and efficiently manufactured and marketed.

It is a further object of the present invention to provide a new adjustable window insulated covering which is of a durable and reliable construction.

An even further object of the present invention is to provide a new adjustable window insulated covering which is susceptible of a low cost of manufacture with regard to both materials and labor, and which accordingly is then susceptible of low prices of sale to the consuming public, thereby making such adjustable window insulated covering economically available to the buying public.

Still yet another object of the present invention is to provide new adjustable window insulated covering which provides in the apparatuses and methods of the prior art some of the advantages hereof, while simultaneously overcoming some of the is advantages normally associated therewith.

Still another object of the present invention is to provide a new adjustable window insulated covering for substantially reducing a user's heating and cooling bills.

Yet another object of the present invention is to provide a new adjustable window insulated covering which includes at least one curtain member having a first layer made of foil material, a second layer made of plastic, and an intermediate layer made of insulating material; and also includes fastening members for fastening the side ends of the at least one curtain member to a window frame. As a first embodiment, the at least one curtain member includes a first and second curtain members which are movably mounted in upper and lower track members which are mounted to the window frame. As a second embodiment, the at least one curtain member is one curtain member which is carried by a roller member which is mounted in a housing which is securely mounted to a top of the window frame. As a third embodiment, the at least one curtain member is one curtain member which is detachably fastened to the window frame over the window with hook and loop fasteners.

Still yet another object of the present invention is to provide a new adjustable window insulated covering that is easy and convenient to install over a window.

Even still another object of the present invention is to provide a new adjustable window insulated covering that substantially prevent air drafts from entering the building structure through the window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
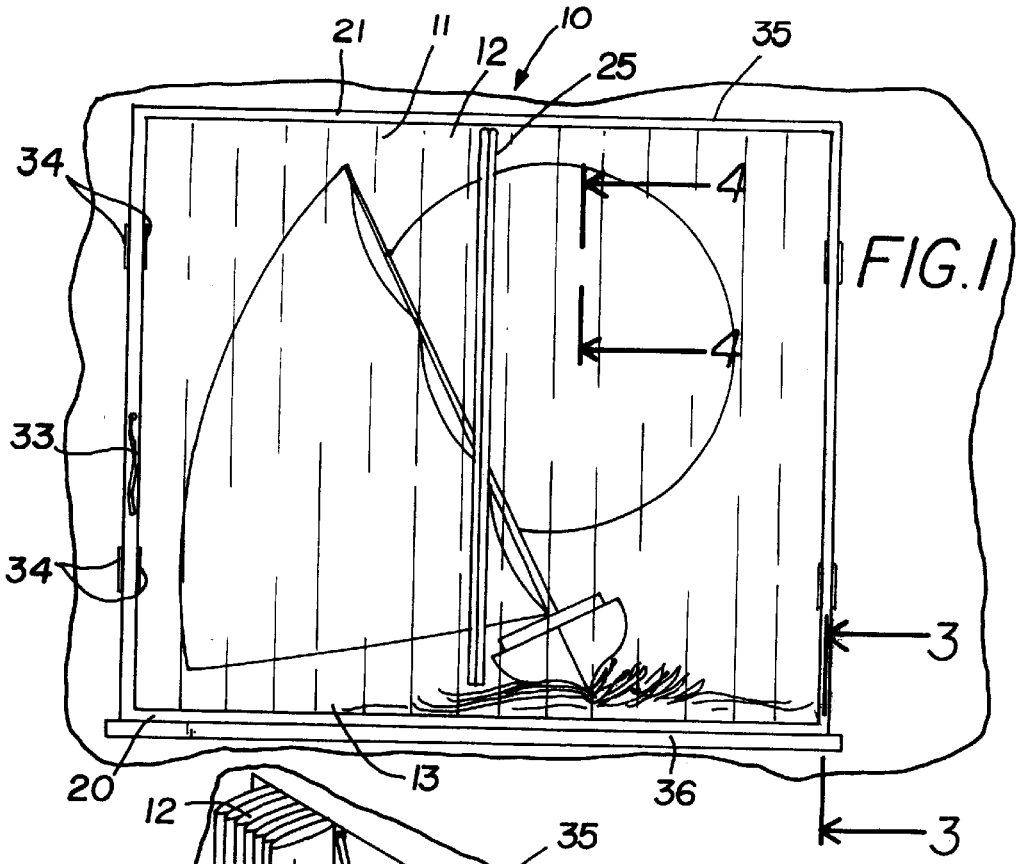
FIG. 1 is a front elevational view of a first embodiment of the new adjustable window insulated covering according to the present invention.
Figure 2:
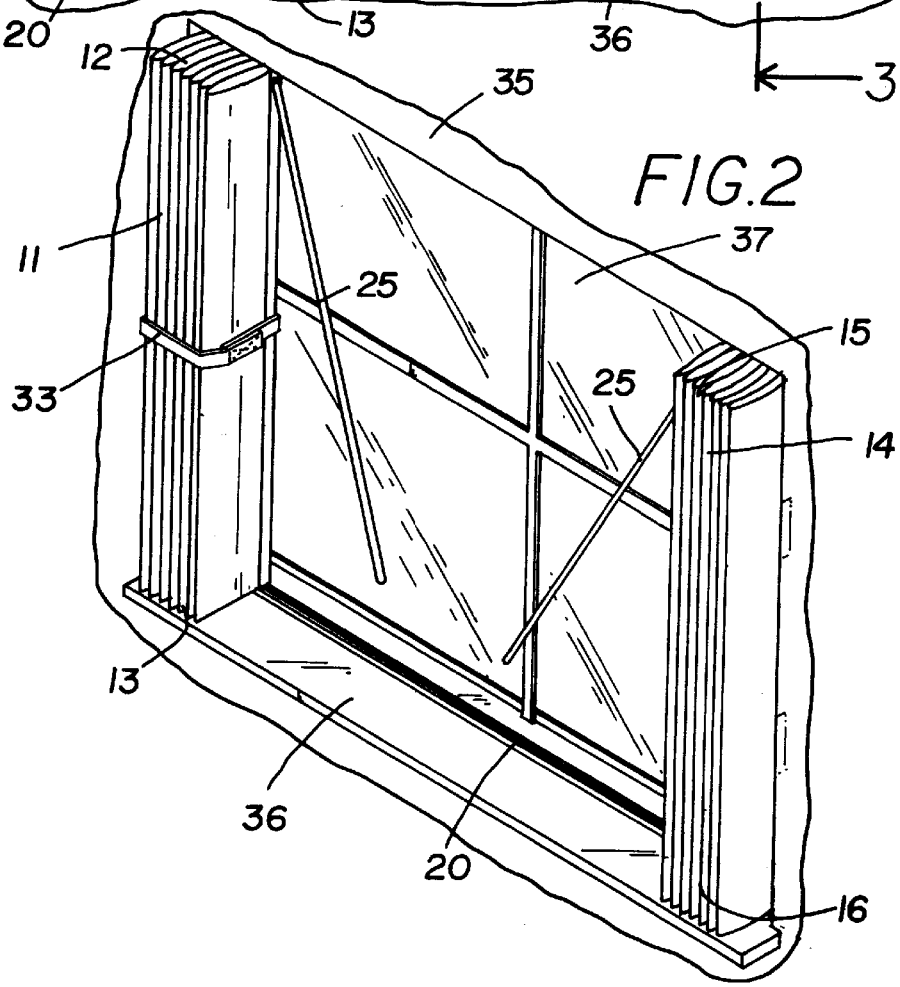
FIG. 2 is a perspective view of the first embodiment of the present invention.
Figure 3:
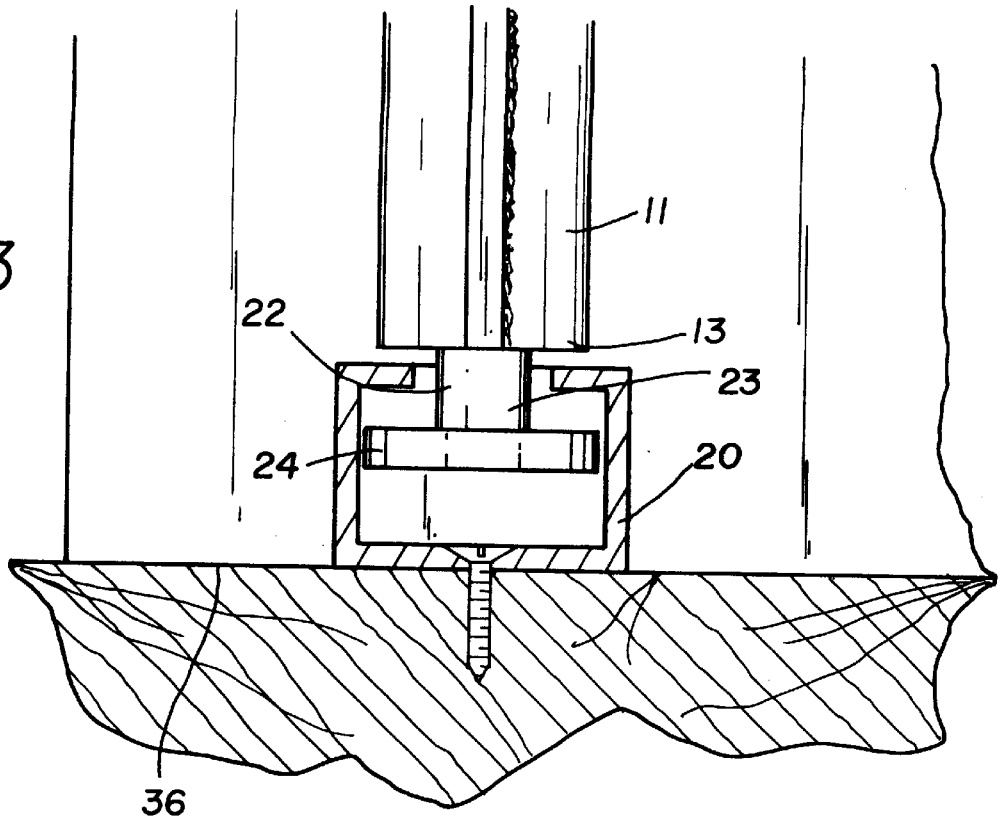
FIG. 3 is a detailed side elevational view of the lower track member of the first embodiment of the present invention.
Figure 4:
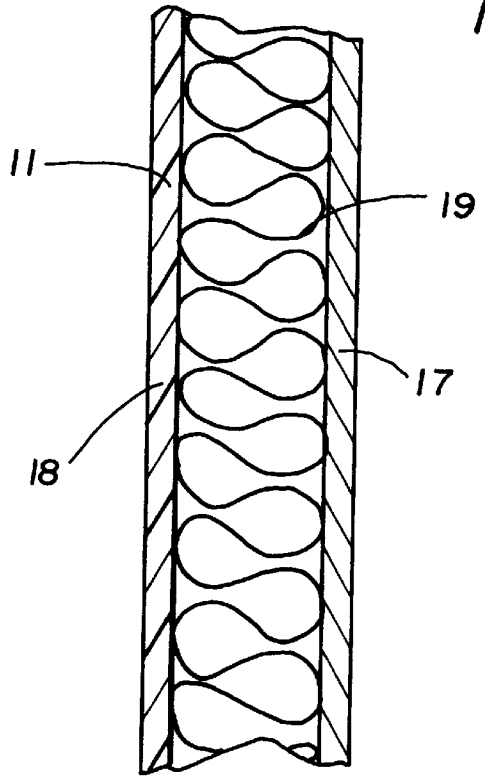
FIG. 4 is a cross sectional view of curtain member of the present invention.
Figure 5:
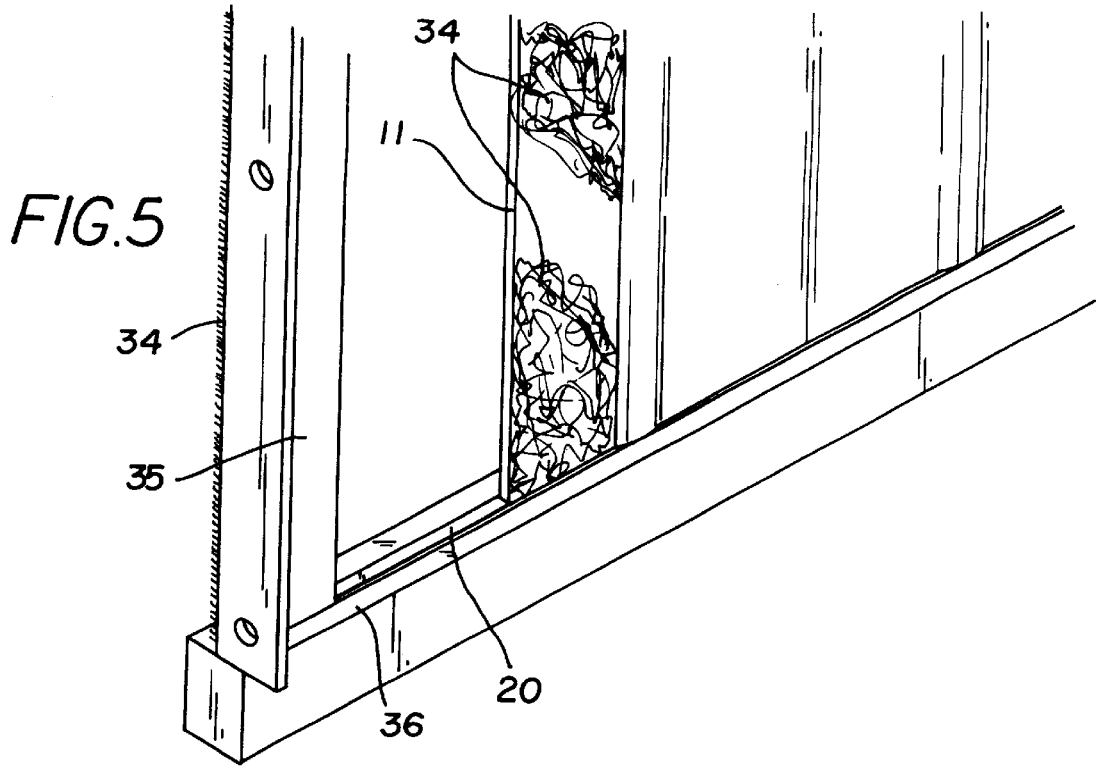
FIG. 5 is a perspective view of the first embodiment of the present invention.
Figure 6:
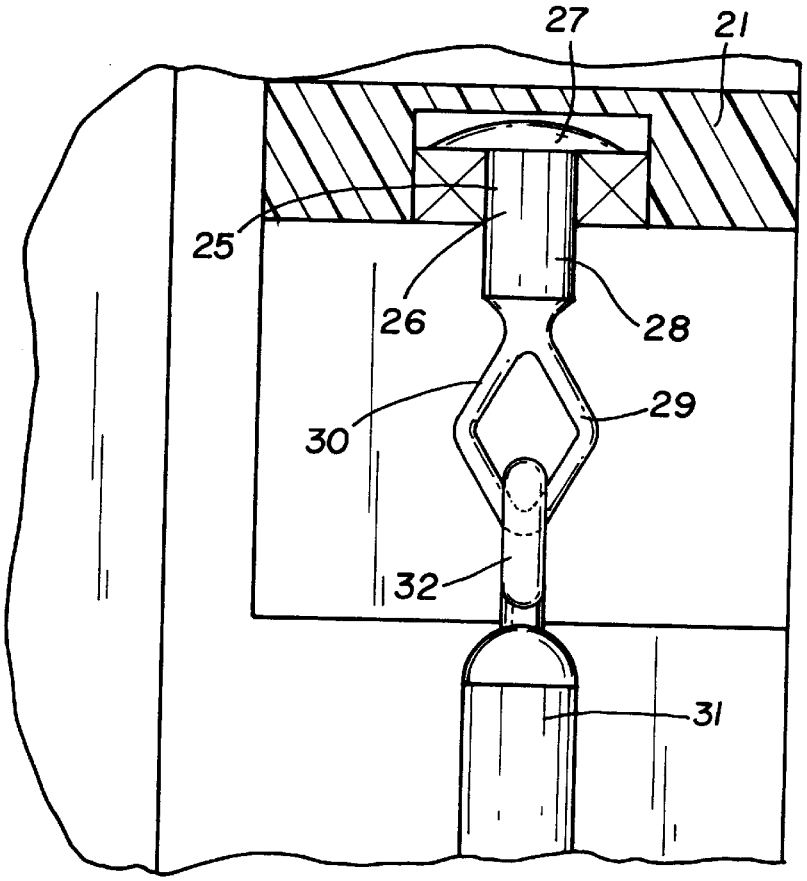
FIG. 6 is a detail side elevational view of the upper track member of the first embodiment of the present invention.
Figure 7:
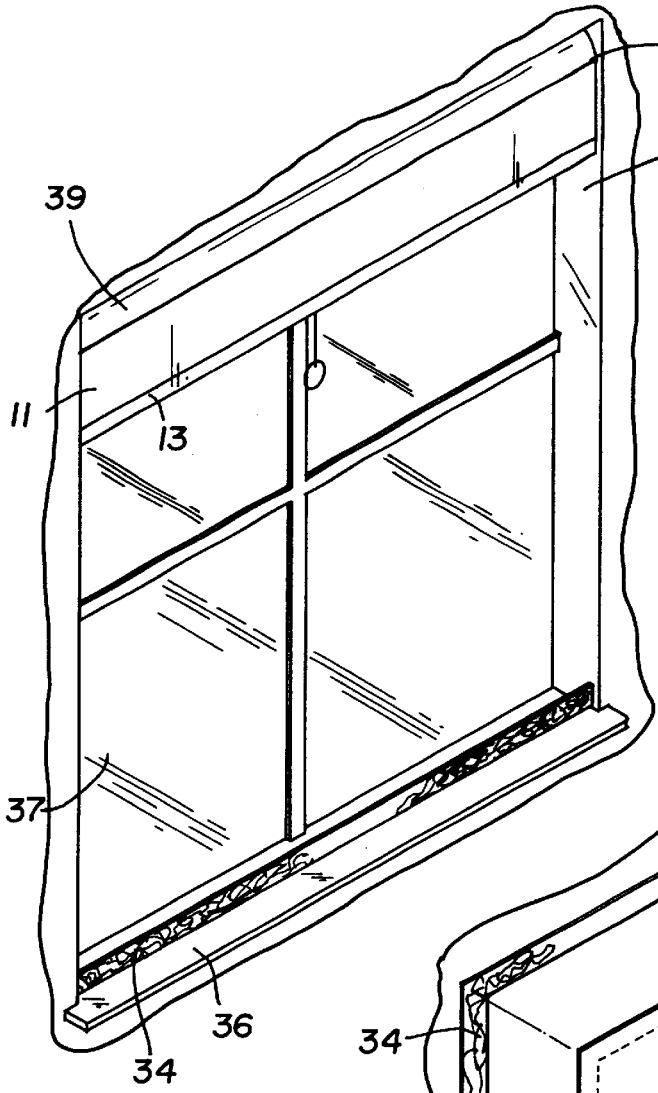
FIG. 7 is a perspective view of the second embodiment of the present invention.
Figure 8:
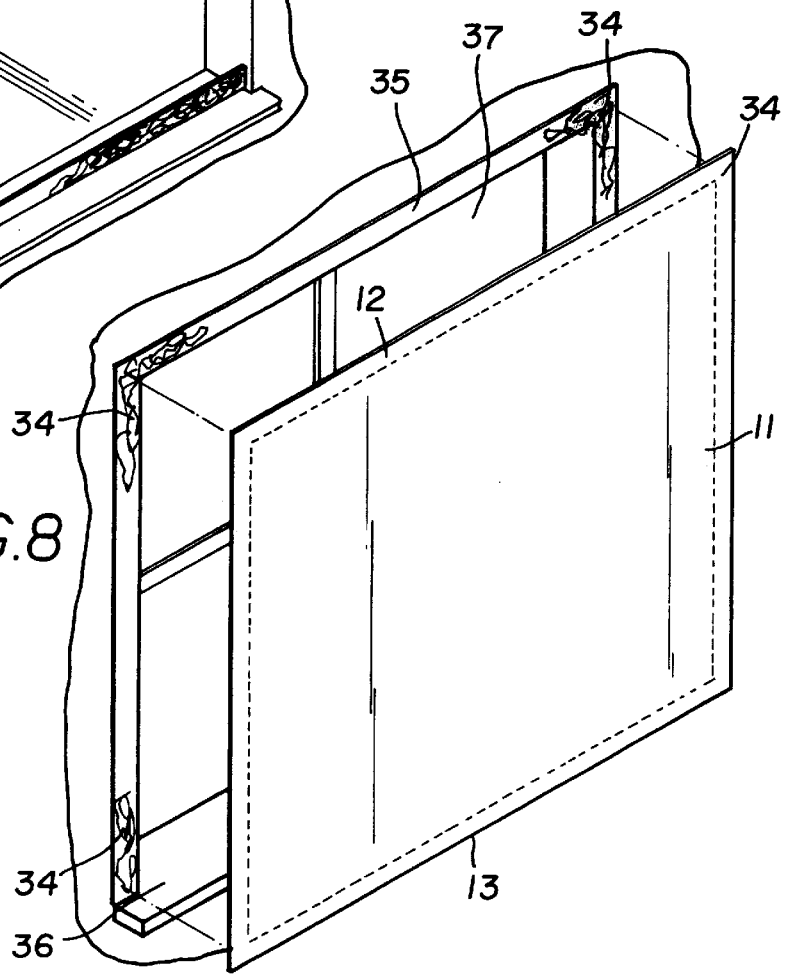
FIG. 8 is a perspective view of the third embodiment of the present invention.

With reference now to the drawings, and in particular to FIGS. 1 through 8 thereof, a new adjustable window insulated covering embodying the principles and concepts of the present invention and generally designated by the reference numeral 10 will be described.

As best illustrated in FIGS. 1 through 8, the adjustable window insulated covering 10 generally comprises at least one curtain member 11,14 having a plurality of layers 17,18,19 and having a bottom end 13,16 and a top end 12,15. The layers 17,18,19 include a first layer 17 which is adapted to face a window 37, a second layer 18 which is adapted to face in a direction opposite the window 37, and an intermediate layer 19 which is securely conventionally disposed between the first 17 and second 18 layers. The first layer 17 includes a foil material, and the second layer 18 also includes a foil material, and the intermediate layer 19 includes a honeycomb insulating material.

As a first embodiment, the least one curtain member 11,14 includes a first 11 and second 14 curtain members. Means adapted for mounting the at least one curtain member 11,14 over the window 37 includes an upper track member 21 adapted to be securely mounted to a top of a window frame 35 and extending a width of the window 37; a lower track member 20 adapted to be securely mounted to a window sill 36 and extending the width of the window 37; a plurality of curtain support members 22 being securely and conventionally attached to the top end 12,15 and the bottom end 13,16 of the first and second curtain members 11,14 and being movably mounted in the upper 21 and lower 20 track members; a pair of curtain moving members 25 each being movably mounted in the upper track member 21 and being conventionally connected to the first and second curtain members 11,14; and fastening members 33,34 adapted for fastening the first and second curtain members 11,14 to sides of the window frame 35. Each of the curtain support members 22 includes a shaft portion 23 securely and conventionally attached to a respective curtain member 11,14, and also includes a disc-shaped portion 24 being movably disposed in a respective track member 20,21. Each of the curtain moving members 25 includes a support member 26 having an enlarged head portion 27 movably disposed in the upper track member 21, and a shaft portion 28 integrally extending therefrom; a swivel member 29 securely and pivotally attached to the shaft portion 28 of the support member 25 and having an eyelet portion 30; and a rod member 31 having a top end and an eyelet member 32 securely and conventionally attached to the top end and being conventionally connected to the eyelet portion 30. The fastening members 33,34 include a plurality of hook and loop fasteners 34 securely attached and sewn to side ends of the curtain members 11,14 and being adapted to be securely attached to sides of the window frame 35. The side ends of the curtain members 11,14 are adapted to detachably attach to the sides of the window frame 35. The fastening members 33,34 also include strap members 33 being adapted to securely mount to the window frame 35 and being extendable and fastenable about the curtain members 11,14.

As a second and third embodiment, the at least one curtain member includes one curtain member 111. For the second embodiment, the means adapted for mounting the at least one curtain member over the window includes a housing 39 adapted to be securely mounted to the top of the window frame 35; a roller member 38 conventionally disposed in the housing 39 and carrying the one curtain member 11, and a plurality of hook and loop fasteners 34 securely and conventionally attached along a bottom end 13 of the one curtain member 11 and being adapted to be securely mounted to the window sill 36.

For the third embodiment, the means adapted for mounting the at least one curtain member over the window includes a plurality of hook and loop fasteners 34 being securely and conventionally attached and sewn to corners of the first layer 17 of the one curtain member 11 and being adapted to securely and conventionally attach at corners of the window frame 35 for detachably attaching the one curtain member 11 over the window 37.

In use, the adjustable insulated window covering 10 can be moved over the window 37 either by sliding the curtain members 11,14 on the track members 20,21 or by unwinding the curtain member 11 down over the window 37 or by fastening the window member 11 over the window 37 directly to the window frame 35 to substantially prevent air drafts from getting into the building structure through cracks in the window 37.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An adjustable window insulated covering comprising:

at least one curtain member having a plurality of layers and having a bottom end and a top end, said layers including a first layer which is adapted to face a window, a second layer which is adapted to face opposite the window, and an intermediate layer which is securely disposed between said first and second layers, said first layer including a foil material, said second layer including a foil material, said intermediate layer including a honeycomb insulating material; and a means adapted for mounting said at least one curtain member over the window;

wherein said at least one curtain member includes a first and second curtain members, and said means adapted for mounting said at least one curtain member over the window includes an upper track member adapted to be securely mounted to a top of a window frame and extending a width of the window; a lower track member adapted to be securely mounted to a window sill and extending the width of the window; a plurality of curtain support members being securely attached to said top end and said bottom end of said first and second curtain members and being movably mounted in said upper and lower track members; a pair of curtain moving members each being movably mounted in said upper track member and being connected to said first and second curtain members; and fastening members adapted for fastening said first and second curtain members to sides of the window frame, each of said curtain support members including a shaft portion securely attached to a respective said curtain member, and also including a disc-shaped portion being movably disposed in a respective said track member, each of said curtain moving members including a support member having an enlarged head portion movably disposed in said upper track member, and a shaft portion extending therefrom; a swivel member securely attached to said shaft portion of said support member and having an eyelet portion; and a rod member having a top end and an eyelet member securely attached to said top end and being connected to said eyelet portion, said fastening members including a plurality of hook and loop fasteners securely attached to side ends of said curtain members and adapted to be securely attached to sides of the window frame, said side ends of said curtain members being adapted to detachably attach to the sides of the window frame, said fastening members including strap members being adapted to securely mount to the window frame and being extendable and fastenable about said curtain members.

2. An adjustable window insulated covering comprising:

at least one curtain member having a plurality of layers and having a bottom end and a top end, said layers including a first layer which is adapted to face a window, a second layer which is adapted to face opposite the window, and an intermediate layer which is securely disposed between said first and second layers; and a means adapted for mounting said at least one curtain member over the window;

wherein said first layer includes a foil material;

wherein said second layer includes a foil material;

wherein said intermediate layer includes a honeycomb insulating material;

wherein said at least one curtain member includes a first and second curtain members;

wherein means adapted for mounting said at least one curtain member over the window includes an upper track member adapted to be securely mounted to a top of a window frame and extending a width of the window; a lower track member adapted to be securely mounted to a window sill and extending the width of the window; a plurality of curtain support members being securely attached to said top end and said bottom end of said first and second curtain members and being movably mounted in said upper and lower track members; a pair of curtain moving members each being movably mounted in said upper track member and being connected to said first and second curtain members; and fastening members adapted for fastening said first and second curtain members to sides of the window frame;

wherein each of said curtain support members includes a shaft portion securely attached to a respective said curtain member, and also includes a disc-shaped portion being movably disposed in a respective said track member; and wherein each of said curtain moving members includes a support member having an enlarged head portion movably disposed in said upper track member, and a shaft portion extending therefrom; a swivel member securely attached to said shaft portion of said support member and having an eyelet portion; and a rod member having a top end and an eyelet member securely attached to said top end and being connected to said eyelet portion.

3. An adjustable insulated window covering as described in claim 2, wherein said fastening members include a plurality of hook and loop fasteners securely attached to side ends of said curtain members and adapted to be securely attached to sides of the window frame, said side ends of said curtain members being adapted to detachably attach to the sides of the window frame.

4. An adjustable insulated window covering as described in claim 2, wherein said fastening members include strap members being adapted to securely mount to the window frame and being extendable and fastenable about said curtain members.

5. An adjustable insulated window covering as described in claim 2, wherein said at least one curtain member includes one curtain member.

* * * * *